US007777598B2

(12) United States Patent
Salehi et al.

(10) Patent No.: US 7,777,598 B2
(45) Date of Patent: Aug. 17, 2010

(54) DIELECTRIC COMBINE CAVITY FILTER HAVING CERAMIC RESONATOR RODS SUSPENDED BY POLYMER WEDGE MOUNTING STRUCTURES

(75) Inventors: Hamid Reza Salehi, Wallingford, CT (US); Teppo M. Lukkarila, Wallingford, CT (US)

(73) Assignee: Radio Frequency Systems, Inc., Meriden, CT (US)

( * ) Notice: Subject to any disclaimer, the term of this patent is extended or adjusted under 35 U.S.C. 154(b) by 19 days.

(21) Appl. No.: 12/102,059

(22) Filed: Apr. 14, 2008

(65) Prior Publication Data

US 2009/0256652 A1 Oct. 15, 2009

(51) Int. Cl.
*H01P 1/20* (2006.01)
*H01P 7/10* (2006.01)

(52) U.S. Cl. ..... 333/202; 333/219.1; 333/235

(58) Field of Classification Search ..... 333/202, 333/219.1, 235, 134
See application file for complete search history.

(56) References Cited

U.S. PATENT DOCUMENTS 4,626,809 A * 12/1986 Mizumura et al. ..... 333/202
4,630,012 A * 12/1986 Fuller et al. ..... 333/235
4,639,699 A * 1/1987 Nishikawa et al. ..... 333/202
4,728,913 A * 3/1988 Ishikawa et al. ..... 333/235
4,896,125 A * 1/1990 Blair et al. ..... 333/219.1
5,311,160 A * 5/1994 Higuchi et al. ..... 333/219.1
5,652,556 A 7/1997 Flory et al.
6,002,311 A 12/1999 Wey et al.
6,222,428 B1 * 4/2001 Akesson et al. ..... 333/202
6,603,374 B1 * 8/2003 Goertz et al. ..... 333/219.1
2006/0132263 A1 * 6/2006 Lamont ..... 333/202

FOREIGN PATENT DOCUMENTS

EP 0399770 A 11/1990
JP 61251207 A 11/1986
JP 2005086716 A 3/2005

OTHER PUBLICATIONS

Hoft, Michael, Bottom Coupling of Combline Resonators for Hybrid Dielectric / Air-Cavity Bandpass Filters, Proceedings of Microwave Conference, 2006. 36th European, IEEE, PI, XP031005826.
Liang, Ji-Fuh et al., High-Q TE01 Mode DR Filters for PCS Wireless Base Stations., IEEE Transactions on Microwave Theory and Techniques, IEEE Service Center, vol. 46, No. 12, 1998.

* cited by examiner

*Primary Examiner*—Benny Lee
(74) *Attorney, Agent, or Firm*—Kramer & Amado P.C.

(57) ABSTRACT

A combline filter has a ceramic resonator disposed inside at least one cavity wall. Because the resonator is implemented as a hollow rod, a tuning element may be inserted into an opening on the top of the rod to tune its frequency. A mounting element, inserted into an opening on the bottom of the rod secures its position inside a cavity resonator. Instead of soldering the resonator to the filter's walls, the resonator is supported above a bottom or side wall of the cavity resonator.

10 Claims, 3 Drawing Sheets

DIELECTRIC COMBINE CAVITY FILTER HAVING CERAMIC RESONATOR RODS SUSPENDED BY POLYMER WEDGE MOUNTING STRUCTURES

BACKGROUND OF THE INVENTION

1. Field of the Invention

This invention relates generally to combline filters for microwave and radio frequency signals and, more particularly, to a structure for suspending a ceramic resonator above a cavity.

2. Description of the Related Art

Coaxial combline filters are widely used in wireless communication systems. More specifically, these devices are often employed to reject unwanted frequencies. When implemented as a bandpass filter, users can tune a combline filter to select a desired range of frequencies, known as a passband, and discard signals from frequency ranges that are either higher or lower than the desired range. The filters are commonly known as combline filters because they consist of a series of parallel structures that resemble the hair-combing teeth in a comb.

A cavity resonator confines electromagnetic radiation within a solid structure, typically formed as a rectangular parallelepiped. Because this cavity acts as a waveguide, the pattern of electromagnetic waves is limited to those waves that can fit within the walls of the waveguide. This restricted mode of wave propagation, usually referred to as the transverse mode, can be analyzed in several categories, depending upon the direction of wave propagation.

Transverse Electric (TE) modes have no electric field in the direction of propagation. In contrast, Transverse Magnetic (TM) modes have no magnetic field in the direction of propagation. Transverse Electro-Magnetic (TEM) modes have neither electric nor magnetic fields in the direction of propagation. While TEM modes can exist in cables, TE and TM modes are present in bounded waveguides, such as cavity resonators. Although a TEM mode could theoretically exist in a waveguide with perfectly conducting walls, real cavity resonators have lossy walls so they cannot support any TEM mode signals.

When designing a cavity resonator, the TM mode is particularly useful. To define TM mode signals in a cavity resonator, the electric field propagates down the center of the guide. Due to the standing wave pattern, the electric and magnetic fields approach zero along the resonator's metallic walls. In order to focus the electric field and permit a user to tune it, a cavity is placed inside the hollow space defined inside the filter's walls.

If the central resonator in a combline filter is metallic, the filter's Quality factor, commonly called the Q-factor, will be poor. This measurement is proportional to the resonator's frequency divided by its conductance, so the unloaded Q-factor will be relatively low if the resonator is made of a conductive material such as metal. Thus, some conventional filters have replaced metal resonators with ceramic resonators having higher dielectric constants.

In such filters, a non-metallic rod of ceramic material in the center of guide allows more precise tuning of the signal frequencies without producing the conductive losses typical of metallic resonators. While the magnetic field flows around the circumference of the cylindrical rod, the discontinuity of permittivity at the resonator's surface allows a standing wave to be supported in its interior. Thus, the electric field will flow down the long axis of the cylindrical resonator.

Because such resonators are typically hollow, a tuning screw may be inserted into a hole in the ceramic, thereby permitting easy adjustment of the rod's resonant frequency. A user may gradually advance the tuning screw, carefully monitoring the resulting variation in the frequency. A specific depth of insertion will correlate to a predictable resonant frequency.

In a traditional TM mode dielectric combline filter, the dielectric in the filter's ceramic resonator must be electrically connected to the housing. This connection often requires the use of complex techniques. For example, a layer of copper, an electrically conductive metal, may be applied to the outside of the ceramic resonator. In these implementations, however, it may be difficult to make the structure stable because it will be vulnerable to mechanical shock. Moreover, ceramic and metallic materials may have different thermal expansion coefficients, so heating and cooling may weaken the strength of the ceramic-metal junction.

Because copper will oxidize if exposed to the air, a second metallic layer is often added to protect the copper. Often, the fabrication process involves adding a passivation layer of lead or tin above the copper layer. In addition to protecting the vulnerable copper layer, this metal is suitable for soldering the ceramic component body into a housing. After plating the ceramic resonator with these metallic layers, solder is applied to couple the plated resonator to the metallic housing. Unfortunately, both the plating and soldering steps involve the use of complex metallurgical techniques, which are expensive and time consuming.

Accordingly, there is a need for a resonator that avoids the use of multiple metal layers, thereby simplifying the device and the process required for its manufacture. Furthermore, there is a need for placing a resonator inside a cavity without directly connecting the resonator to the conductive walls of the cavity.

SUMMARY OF THE INVENTION

In light of the present need for suspending a resonator in a cavity, a brief summary of various exemplary embodiments is presented. Some simplifications and omissions may be made in the following summary, which is intended to highlight and introduce some aspects of the various exemplary embodiments, but not to limit its scope. Detailed descriptions of preferred exemplary embodiments adequate to allow those of ordinary skill in the art to make and use the inventive concepts will follow in later sections.

In various exemplary embodiments, a combline filter achieves the same performance as a conventional combline filter without the need to attach the resonator to the housing with solder. This results in a much simpler structure. Thus, in various exemplary embodiments instead of coating the ceramic resonator with metallic layers to couple it to the cavity, a mounting structure supports the resonator inside the cavity and a suspension structure holds it above the cavity. This structural arrangement eliminates the need for the complex process of adding copper and tin-lead layers that is necessary for conventional resonators.

Accordingly, in various exemplary embodiments, a dielectric combline cavity resonator comprises: a cavity having at least one conductive wall that defines a space for confining electromagnetic waves; a ceramic resonator rod having inner and outer perimeters defined for opposed first and second surfaces wherein the rod is disposed within the cavity without contacting the cavity's at least one metallic wall; a tuning element that electromagnetically couples the cavity to the rod, the tuning element engaging the rod's first surface by fitting within its inner perimeter; and a mounting structure that suspends the rod within the cavity.

In various exemplary embodiments, the cavity may be a rectangular parallelepiped having a top surface, a bottom surface, and four side surfaces. The rod may operate in the transverse magnetic (TM) mode.

In various exemplary embodiments, the mounting structure may comprise a mounting element that engages the rod's second surface, by fitting within its inner diameter. The mounting structure may further comprise an alumina layer separating the cavity from the rod's second surface.

Alternatively, the mounting structure may comprise at least one polymer wedge that secures the rod within the cavity. The mounting structure may further comprise at least one securing element that couples the at least one polymer wedge to the cavity.

In various exemplary embodiments, the at least one conductive wall of the cavity may be metallic. Alternatively, the at least one conductive wall may be made from a metallized polymer.

In various exemplary embodiments, a bandpass filter has a particular bandwidth over a selected range of frequencies and a center frequency, the filter comprising a plurality of suspended combline cavity resonators, wherein each cavity resonator comprises: a cavity having at least one metallic wall that defines a space for confining electromagnetic waves; a ceramic resonator rod having inner and outer perimeters defined for opposed first and second surfaces, wherein the rod is disposed within the cavity without contacting the cavity's at least one metallic wall; a tuning element that electromagnetically couples the cavity to the rod, the tuning element engaging the first surface of the rod by fitting within its inner perimeter; and a mounting structure that suspends the rod within the cavity.

In various exemplary embodiments, the mounting structure of each cavity resonator may comprise a mounting element that engages the rod's second surface by fitting within its inner perimeter. The mounting structure of each cavity resonator may further comprise an alumina layer separating the cavity from the rod's second surface. Alternatively, the mounting structure of each cavity resonator may comprise at least one polymer wedge that secures the rod within the cavity. The mounting structure of each cavity resonator may further comprise at least one securing element that couples the at least one polymer wedge to the cavity.

In various exemplary embodiments, the filter's cavity may be a rectangular parallelepiped having a top surface, a bottom surface, and four side surfaces. In various exemplary embodiments, the same cavity can be used in a stop band filter, also known as a band stop or band rejection filter. Such filters function in an inverse manner when compared to bandpass filters. In general, a stop band filter attenuates signals within a selected band of frequencies, but otherwise permits signals to freely pass through it.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1:
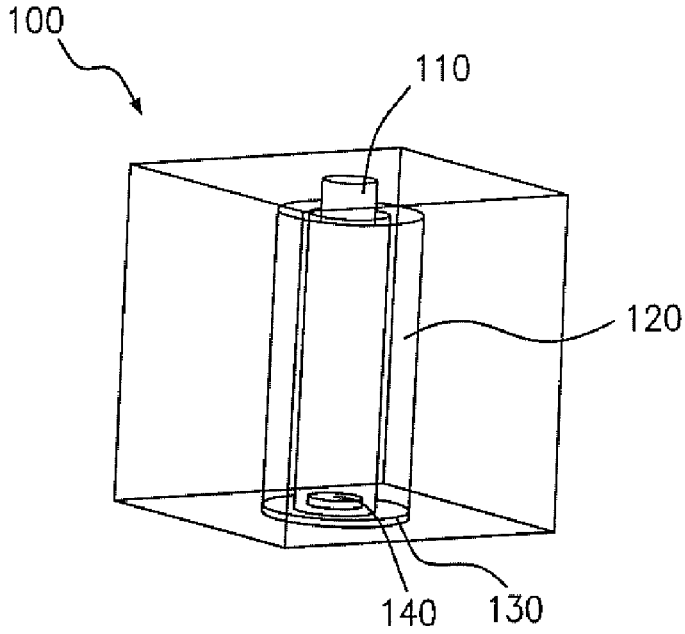
FIG. 1 is a perspective view of an exemplary suspended TM mode dielectric combline cavity.

Referring now to the drawings, in which like numerals refer to like components or steps in the drawings, there are disclosed broad aspects of various exemplary embodiments.

FIG. 1 is a perspective view of an exemplary suspended TM mode dielectric combline cavity 100. In various exemplary embodiments, cavity 100 includes a tuning element 110, a resonator 120, a support disk 130, and amounting element 140. Cavity 100 is defined by at least one electrically conductive wall. In various exemplary embodiments, such walls may either be metallic or made from a metallized polymer.

In various exemplary embodiments, cavity 100 has the shape of a rectangular parallelepiped. Thus, cavity 100 may consist of a top side, a bottom side, and four side walls. As will be appreciated by those skilled in the art, cavity resonators may be fabricated in shapes other than rectangular parallelepipeds, such as spheres and cylinders.

In various exemplary embodiments, a tuning element 110 extends downward from the top side of cavity 100 to a cylindrical resonator 120 inside cavity 100. The top of tuning element 110 may be located substantially in the middle of the top side of cavity 100. A user may adjust tuning element 110, either moving it upward or downward. This adjustment may proportionally alter the resonant frequency of cavity 100.

In various exemplary embodiments, because resonator 120 has the form of a hollow cylinder, the motion of tuning element 110 can either insert it into a hole at the top of resonator 120 or remove it from that hole. In this way, the user can precisely adjust the frequency of resonator 120. Alternatively, resonator 120 may have a shape that does not have an annular cross-section, but still defines inner and outer perimeters. In this case, tuning element 110 must be properly shaped to match the configuration of the inner perimeter of resonator 120.

Moreover, while resonator 120 is depicted along a vertical axis of cavity 100, resonator 100 may be disposed along other axes within cavity 100. For example, it could be disposed along a horizontal axis of cavity 100, having tuning element 110 on its left side. Regardless of its configuration within the cavity, resonator 120 may generally be described as having inner and outer perimeters defined for its two opposed sides. Tuning element 110 engages the inner perimeter of one side, while the other side is located on the opposite side of resonator 120.

Furthermore, in various exemplary embodiments, ceramic material may be used in resonator 120. This ceramic material may have a dielectric constant of substantially higher than that of air.

In various exemplary embodiments, resonator 120 does not extend all the way to the bottom side of cavity 100. Instead, a support disk 130 separates the bottom side of resonator 120 from the bottom side of cavity 100. Thus, in these embodiments, there is no need to solder resonator 120 to the walls of cavity 100. In various exemplary embodiments, support disk 130 is made of alumina. Alumina, a compound with the chemical formula $Al_2O_3$, is also known as aluminum oxide. It should be apparent, however, that any material having equivalent properties that is suitable for supporting resonator 120 may be used.

In various exemplary embodiments, the alumina layer has a dielectric constant of substantially 9.8. Furthermore, in various exemplary embodiments, the loss tangent of the layer is substantially 0.0005, ensuring that very little power is dissipated in support disk 130. To achieve this dielectric constant and loss tangent, fabrication of support disk 130 may use alumina that is substantially 99.5% pure. It should be apparent, however, that a material having different properties that is suitable for supporting resonator 120 may be used.

In various exemplary embodiments, a mounting element 140 protrudes from the top of support disk 130. Mounting element 140 may be located opposite tuning element 110, substantially in the middle of support disk 130 above the bottom of cavity 100. Because mounting element 140 extends upward into the hole at the bottom of resonator 120, it locks resonator 120 in place inside cavity 100.

Figure 2:
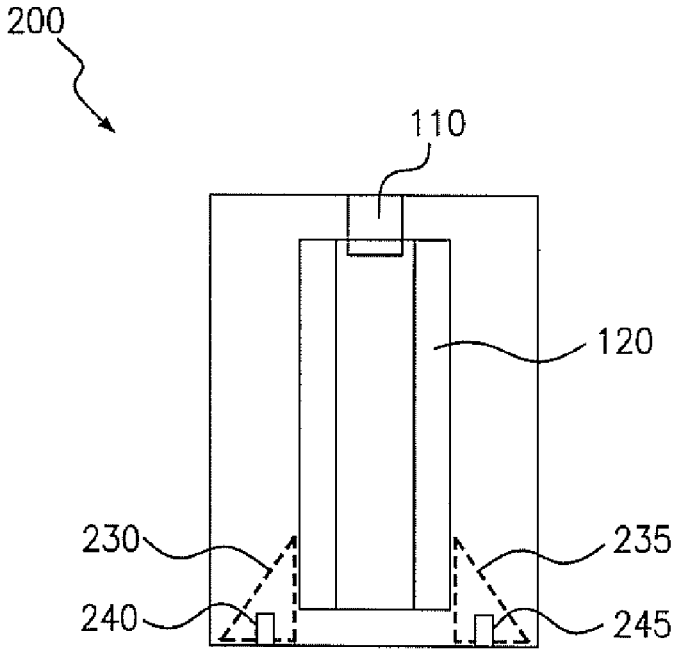
FIG. 2 is a cross-sectional view of an exemplary cavity having a two-dimensional cross-section taken along the axis of the dielectric resonator.

FIG. 2 is a cross-sectional view of an exemplary cavity 200 having a two-dimensional cross-section taken along the axis of the dielectric resonator and including tuning element 110.

In various exemplary embodiments, first and second polymer supports 230, 235 are employed to lock resonator 120 in position, in lieu of mounting element 140 shown in FIG. 1. Polymer supports 230, 235 may comprise two polymer wedges having triangular cross-sections, located on either side of resonator 220. First and second securing elements 240, 245 may couple first and second polymer supports 230, 235 to the bottom of cavity 200. It should be apparent to those skilled in the art that equivalent structures may be used to secure resonator 120, provided that the support secures resonator 120 in a position that does not contact the walls of cavity 200. For example, supports 230, 235 may be replaced by a single piece encompassing the outer perimeter of resonator 120. Other configurations will be apparent to those of ordinary skill in the art.

Figure 3:
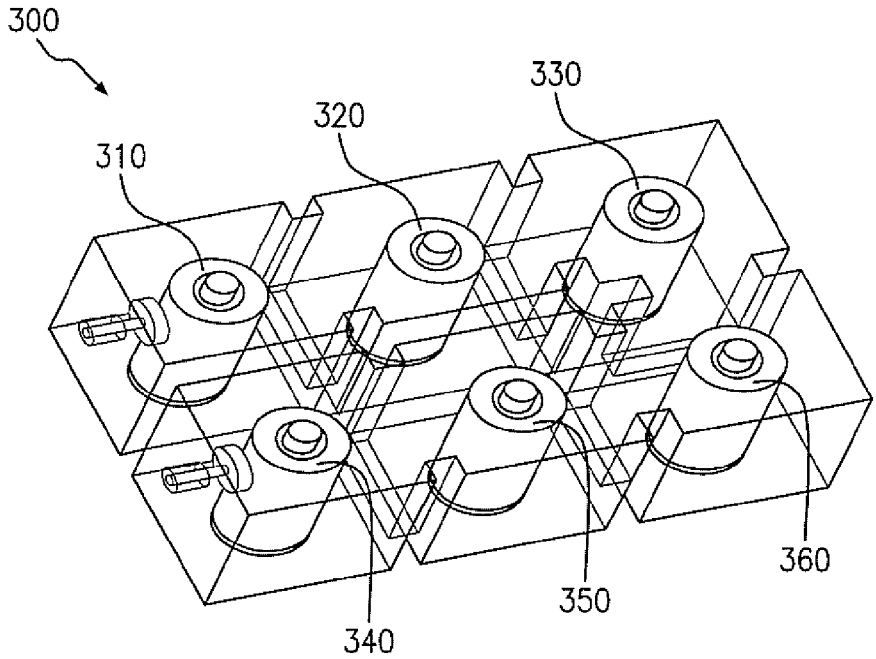
FIG. 3 is a perspective view of an exemplary configuration of a six-pole suspended dielectric combline cavity filter.

FIG. 3 is a perspective view of an exemplary configuration of a six-pole suspended dielectric combline cavity filter 300. Filter 300 includes six individual cavities 310, 320, 330, 340, 350, and 360.

As shown in FIG. 3, six-pole filter 300 consists of six cavities of the type described above in connection with FIG. 1. The individual cavities 310, 320, 330, 340, 350, and 360 are arranged in a three-by-two array to carefully tune the frequency response of the electromagnetic waves within cavity 300. In the top row, irises couple cavity 310 to cavity 320 and cavity 320 to cavity 330. In a similar arrangement, irises in the bottom row couple cavity 340 to cavity 350 and cavity 350 to cavity 360. A final iris combines signals from cavities 330 and 360.

Figure 4:
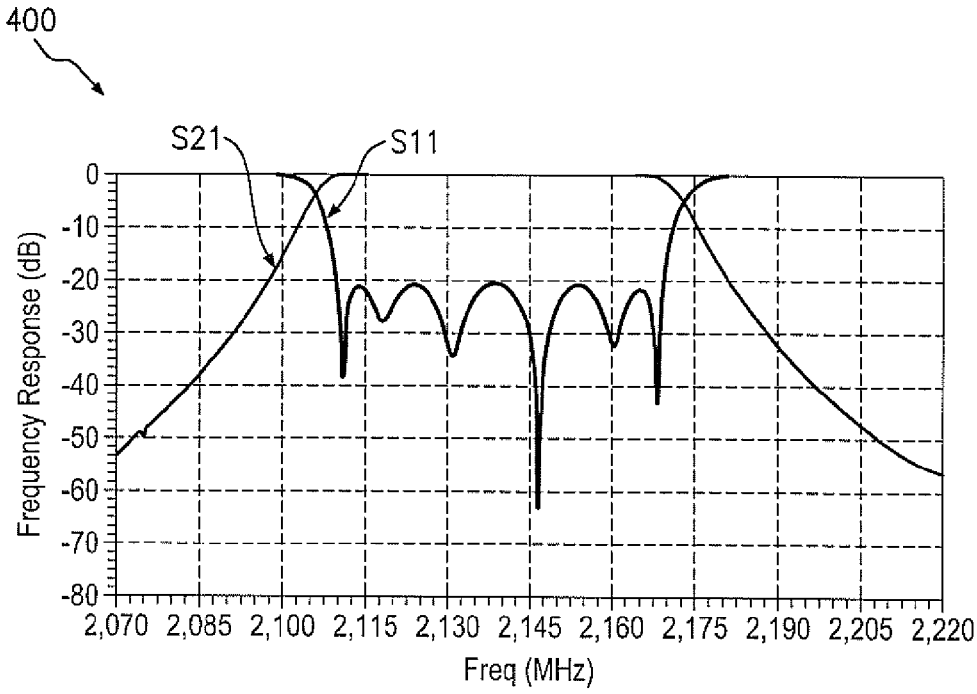
FIG. 4 shows a frequency response diagram for the exemplary filter of FIG. 3.

FIG. 4 shows an exemplary frequency response diagram 400 of cavity 300 of FIG. 3. By comparing the frequency response S11, S21, measured in decibels (dB), to the frequency, measured in MegaHertz (MHz), this diagram demonstrates how the cavity configuration of FIG. 3 produces a six pole response. In this example, the six poles are located at roughly 2113, 2117, 2131, 2147, 2160, and 2168 MHz. The exemplary frequency response is below −60 dB for the pole located at roughly 2147 MHz. Other filter functions can be constructed using the resonator, including a response with one or several transmission zeros.

Figure 5:
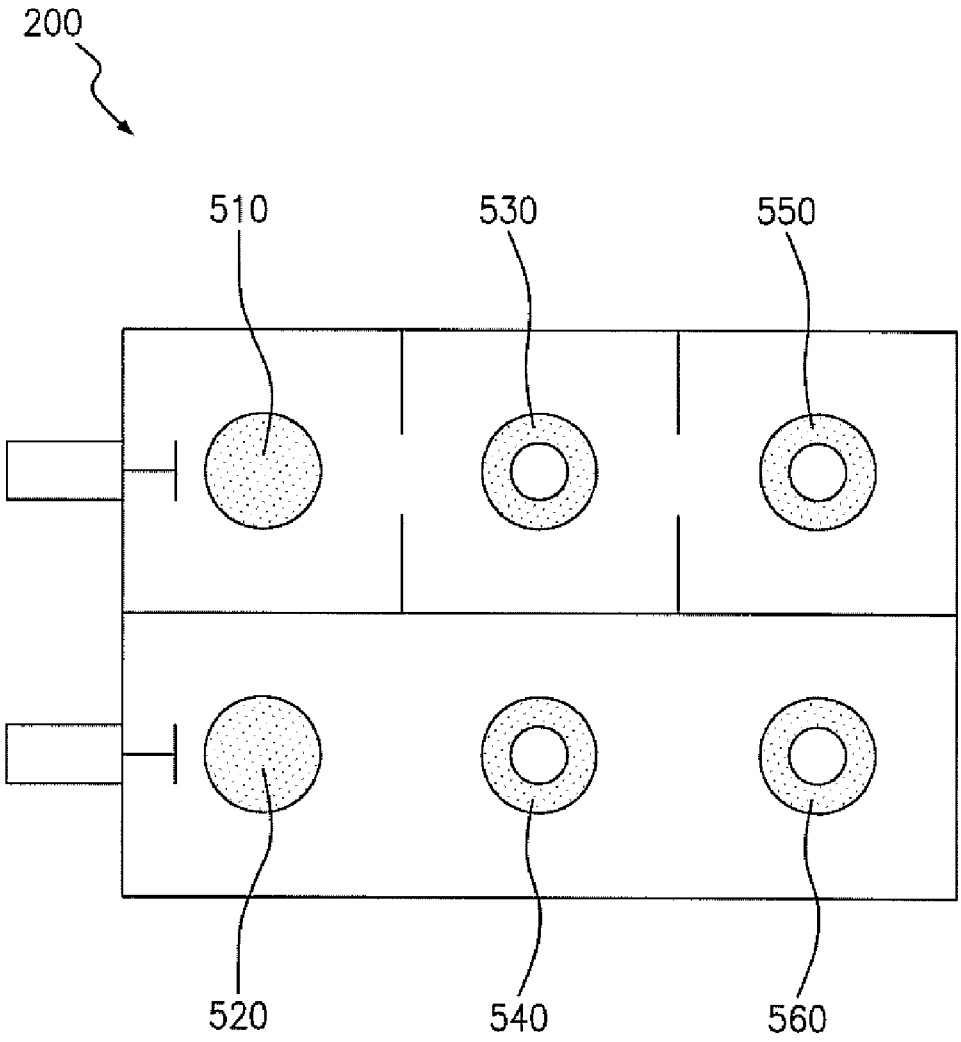
FIG. 5 shows a combination of metallic combline resonators and suspended dielectric combline resonators.

FIG. 5 shows a filter 500 that combines both metallic combline resonators 510, 520 and suspended dielectric combline resonators 530, 540, 550, 560. On the left side of the drawing, signals are received by or transmitted from the metallic combline resonators 510, 520. A first pair of irises couples metallic resonator 510 to dielectric resonator 530 and metallic resonator 520 to dielectric resonator 540. A second pair of irises couples dielectric resonator 530 to dielectric resonator 550 and dielectric resonator 540 to dielectric resonator 560. A final iris combines the signal from top three resonators 510, 530, 550 with the signal from the bottom three resonators 520, 540, 560 by coupling dielectric resonator 550 to dielectric resonator 560.

According to the forgoing, various exemplary embodiments describe significant advantages over conventional combline filters. In various exemplary embodiments, a suspended resonator rod does not directly contact the walls of the cavity housing it, thereby eliminating the need for complex metallurgical techniques for soldering the rod to the housing.

Although the various exemplary embodiments have been described in detail with particular reference to certain exemplary aspects thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A dielectric combline cavity resonator comprising:

a cavity having at least one conductive wall that defines a space for confining electromagnetic waves;

a ceramic resonator rod having inner and outer perimeters defined for opposed first and second surfaces, wherein said ceramic resonator rod is disposed within said cavity without contacting said at least one conductive wall;

a tuning element that electromagnetically couples said cavity to said ceramic resonator rod, said tuning element engaging said first surface of said ceramic resonator rod by fitting within said inner perimeter; and a mounting structure that suspends said ceramic resonator rod within said cavity, wherein said mounting structure comprises at least one polymer wedge having a locking surface parallel to the outer perimeter of the ceramic resonator rod that extends along the outer perimeter of the ceramic resonator rod for a sufficient distance to secure said rod within said cavity.

2. The cavity resonator of claim 1, wherein said cavity is a rectangular parallelepiped having said at least one conductive walls defining a top surface, a bottom surface, and four side surfaces.

3. The cavity resonator of claim 1, wherein said ceramic resonator rod operates in the transverse magnetic (TM) mode.

4. The cavity resonator of claim 1, wherein said mounting structure further comprises at least one securing element that couples said at least one polymer wedge to said cavity.

5. The cavity resonator of claim 1, wherein said at least one conductive wall is metallic.

6. The cavity resonator of claim 1, wherein said at least one conductive wall comprises a metallized polymer.

7. A bandpass filter having a particular bandwidth over a selected range of frequencies and a center frequency, said filter comprising:

a plurality of suspended combline cavity resonators, wherein each cavity resonator comprises:

a cavity having at least one conductive wall that defines a space for confining electromagnetic waves, a ceramic resonator rod having inner and outer perimeters defined for opposed first and second surfaces, wherein said ceramic resonator rod is disposed within said cavity without contacting said at least one conductive wall, a tuning element that electromagnetically couples said cavity to said ceramic resonator rod, said tuning element engaging said first surface of said ceramic resonator rod by fitting within said inner perimeter, and a mounting structure that suspends said rod within said cavity, wherein said mounting structure of each cavity resonator comprises at least one polymer wedge having a locking surface parallel to the outer perimeter of the ceramic resonator rod that extends along the outer perimeter of the ceramic resonator rod for a sufficient distance to secure said ceramic resonator rod within said cavity.

8. The bandpass filter of claim 7, wherein said mounting structure of each cavity resonator further comprises:

at least one securing element that couples said at least one polymer wedge to said corresponding cavity.

9. The bandpass filter of claim 7, wherein said cavity in each cavity resonator is a rectangular parallelepiped having said at least one conductive wall defining a top surface, a bottom surface, and four side surfaces.

10. A filter comprising a combination of at least one metal combline cavity resonators and at least one suspended dielectric combline cavity resonator, wherein each said suspended dielectric combline cavity resonator comprises:

a cavity having at least one conductive wall that defines a space for confining electromagnetic waves;

a ceramic resonator rod having inner and outer perimeters defined for opposed first and second surfaces, wherein said ceramic resonator rod is disposed within said cavity without contacting said at least one conductive wall;

a tuning element that electromagnetically couples said cavity to said ceramic resonator rod, said tuning element engaging said first surface of said ceramic resonator rod by fitting within said inner perimeter; and a mounting structure that suspends said ceramic resonator rod within said cavity, wherein said mounting structure comprises at least one polymer wedge having a locking surface parallel to the outer perimeter of the ceramic resonator rod that extends along the outer perimeter of the ceramic resonator rod for a sufficient distance to secure said ceramic resonator rod within said cavity.

* * * * *

UNITED STATES PATENT AND TRADEMARK OFFICE

CERTIFICATE OF CORRECTION

PATENT NO. : 7,777,598 B2
APPLICATION NO. : 12/102059
DATED : August 17, 2010
INVENTOR(S) : Hamid Reza Salehi and Teppo M. Lukkarila It is certified that error appears in the above-identified patent and that said Letters Patent is hereby corrected as shown below:

Column 6, Claim 2, line 44, change "walls" to "wall".

Signed and Sealed this

Fifth Day of October, 2010

David J. Kappos

David J. Kappos
*Director of the United States Patent and Trademark Office*